United States Patent [19]

Keller

[11] Patent Number: 5,011,575

[45] Date of Patent: Apr. 30, 1991

[54] INCLINED MULTIPLYFORMER

[75] Inventor: Martin B. Keller, Hudson Falls, N.Y.

[73] Assignee: Sandy Hill Corporation, Hudson Falls, N.Y.

[21] Appl. No.: 537,643

[22] Filed: Jun. 14, 1990

[51] Int. Cl.[5] ..... D21F 1/00

[52] U.S. Cl. ..... 162/299; 162/336; 162/343

[58] Field of Search ..... 162/298, 299, 336, 343, 162/344, 347, 350

[56] References Cited

U.S. PATENT DOCUMENTS

| | | | |
|---|---|---|---|
| 3,598,696 | 8/1971 | Beck | 162/343 |
| 3,785,922 | 1/1974 | Keller | 162/350 |
| 3,923,593 | 12/1975 | Verseput | 162/343 |

FOREIGN PATENT DOCUMENTS

| | | | |
|---|---|---|---|
| 2078812 | 1/1982 | United Kingdom | 162/336 |

*Primary Examiner*—Karen M. Hastings

*Attorney, Agent, or Firm*—Ross, Ross & Flavin

[57] ABSTRACT

A papermaking machine including the combination of an endless moving screen having an upwardly-inclined run, a primary open headbox for supplying a moving stream of a primary liquid slurry into contact with the screen for forming a first sheet-like structure on the screen, the primary headbox including a pond regulator for cooperantly defining a discharge end for enhancing the discharge of the stream of liquid slurry into the upwardly-inclined run of the screen, a secondary closed headbox in a piggyback relation to and integrated with the pond regulator for supplying a moving stream of a secondary liquid slurry into contact with the screen and the advancing first sheet-like structure.

1 Claim, 1 Drawing Sheet

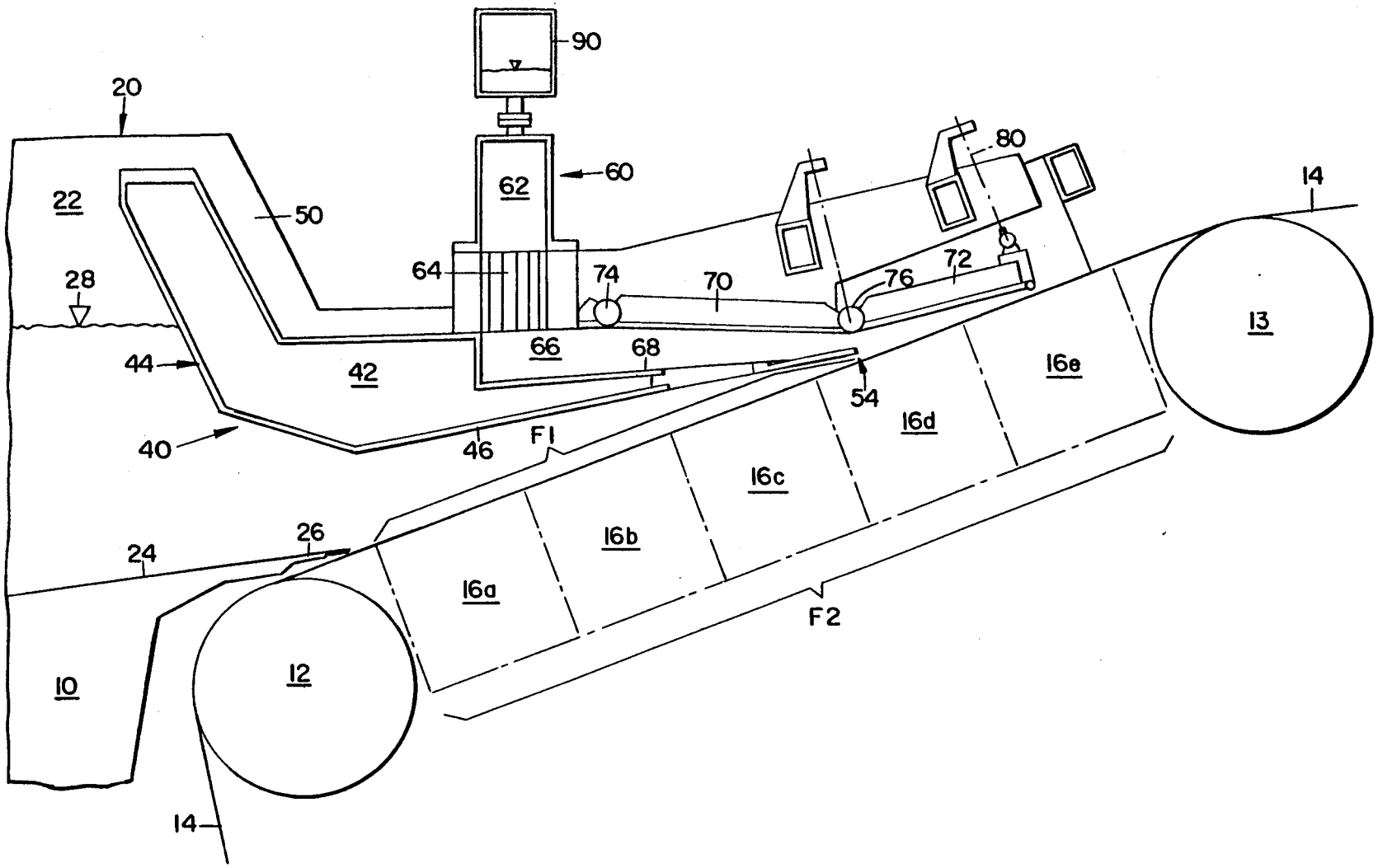
14
13
16e
16d
16c
16b
16a
F2
F1
80
72
76
54
70
68
74
60
90
62
66
64
46
42
50
26
12
14
20
22
28
44
40
24
10

INCLINED MULTIPLYFORMER

This invention relates to a two-stock delivery system for an inclined Fourdrinier type of papermaking machine.

It teaches new and useful structural refinements in equipment for the formation of two-ply sheet-like structures envisioning apparatus incorporating an endless forming wire or screen of the Fourdrinier type and a cooperant stock delivery mechanism and an associated pond regulator capable of accommodating a large volume of a free-draining aqueous suspension of fibers known as a slurry or pond and designed to allow regulation of the linear velocity of its slurry without permitting loss of the turbulence required to attain optimum dispersion thereof and a secondary stock delivery mechanism disposed in piggy-back relation to the primary delivery mechanism, all so as to achieve herewith the laying down of a plurality of layers of stock in seriatim upon an upwardly-traveling inclined section of the forwardly-moving run of the wire.

The web forming means in the form of the continuously-traveling forming wire travels upwardly at an angle during its passage through a part of the web forming zone of the machine, the suspensions of fibers dispersed in water being delivered independently of each other at spaced points along the inclined section of the wire and with predetermined velocities through discharge orifices or slices of the separate stages for deposit upon the wire, through which wire, by means of capillary action and surface tension, the water is drained so as to leave upon the upper planar surface thereof mats or webs of fibers, one superposed upon the other according to the order of their delivery thereto.

The desideratum is to supply to each increment or subzone of the web-forming area uniform distribution of fibers, under steady-state flow conditions, in the form of a moving mass of water and fiber in suspension, moving in the machine direction under such pressure as allows a delivery velocity substantially equal to the wire speed, with the water being drained through the wire either freely or by accelerated draining as induced by suction boxes located under the inclined section of the wire.

In the conventional Fourdrinier machine, a certain volume of fiber suspension is discharged from a headbox through the slice and is deposited upon the wire. The general desideratum of the suspension carrying the exact same concentration of fiber at every point transversely of the wire frequently fails wherefor heavy and light streaks across the sheet result. With the invention hereof, contrariwise, means is provided to control this unevenness before the stock exits from the pond, whereby a levelness of a degree heretofore unobtainable is achievable.

Webs of very different and special characteristics may be obtained by proper fiber selection. For example, thermoplastic fibers may be used to give heat sealing properties. Likewise, fibers with a high degree of shrinkage or a high degree of stretch may be employed. For other purposes, the fibers may consist of some which are soluble in certain solvents and insoluble in others.

Owing to the allowability of a very wet paper web with a textile web, it is possible to obtain practically unlimited combinations. For example, it may be desired to form a final web having entirely opposite characteristics on its two sides as where one side may be composed of very short, highly hydrated fibers forming a thin filmlike paper web, while the other side may be composed of long, soft textile-length fibers entirely dissimilar in physical characteristics. Or one side may be made highly impervious to liquids while the other side may be made highly absorbent.

Grain ratio, porosity, flexibility and strength may be controlled to a degree not possible heretofore. The webs and the components of the webs may be made as thick or thin as desired within a practical range. In general, the maximum thickness which can be obtained in the final web will be about one-eighth inch.

Papermaking and textile fibers can be formed by the means hereof into a combined web or papermaking or textile fibers may be used alone.

The textile fibers used can be any fibers whether synthetic, regenerated or natural fibers, virgin or reclaimed. By textile fiber is meant a staple fiber having a minimum fiber length of one-half inch, such as can be run on a carding machine to form a sliver.

The papermaking fibers used can be any of the natural fibers as used in the usual papermaking processes, such as wood, jute, cotton and sisal, either in their full fiber length or refined and hydrated to shorter lengths to give increased strength. They can also be of longer length and may include synthetic fibers in which longer fiber lengths are used as compared to usual papermaking practices, such as viscose, acetate rayon and the like.

Structures formed herewith may contain fibers of papermaking length and of textile length, so as to be considerably stronger and more uniform than non-woven fabrics heretofore formed, while possessing high degrees of softness, absorbency, flexibility and porosity, and offering other characteristics normally associated with cloth-like materials.

The invention envisions means for continuously forming laminated webs or non-woven sheet-like structures made up of a pair of plies containing the same or different types and/or ratios of fibers or fibrids, which means comprehends a headbox inclusive of plural distributing devices in stepped relation as to each other, and nested within the headbox in manner to contain separate slurries above the web forming surface of the inclined section of the wire and cooperant instrumentalities for controlling flows of these separate slurries to, and the in seriatim deposition upon, the wire in layers of desired thicknesses, all while the wire is continually motivated linearly beneath and relative to the slurries, thereby achieving the exertion of static pressures upon the wire.

It is possible to produce a web or non-woven sheet-like structure of diversified fiber content and having superior physical characteristics, same formed through one aqueous dispersion of fibers delivered at one stage, which dispersion may be of one type, into a base layer or ply and, while such base layer or ply newly-formed upon the wire remains in a sufficiently fluid condition, depositing thereupon, through the means of a second stage headbox, another dispersion of fibers, which may be of the same or different type, in manner such that the fibers of the secondary layer or ply are securely and uniformly bonded to those fibers of the base layer or ply so as to form a coherent web.

The fibers of the named layer are securely and uniformly bonded to the fibers of the earlier-produced coherent web, all with the singular advantage that complete fiber intermingling is attainable, free of the websplitting tendency commonly experienced on like machine operations heretofore known.

A pond regulator or stock-flow regulator is provided in association with a headbox as to define a pond chamber which converges relative to the wire and in the direction of movement of the wire to allow a control of the flow of stock under the regulator and over the forming area of the wire, the pond regulator being adjustable up and down and fore and aft such that the lower wall thereof may be adjustably positioned relative to the wire as to obtain the desired and predetermined slice dimension according to wire speed, stock characteristics, stock velocity, desired web characteristics, and other variables.

In known prior art devices, the stock is permitted to squirt and spatter onto the forming area. In contradistinction, by the apparatus hereof, the stock is "captured," within the width of the forming area wherewith water may be removed under controlled conditions.

Pressure is controlled within an approach passage by way of allowed adjustments in the positioning of a pond regulator in close proximity to or distantly from the wire. The closer the pond regulator to the forming surface, the narrower the discharge, and accordingly, the greater the flow velocity in the forming area for any given gallonage or quantity of flow. Too, the production of a web having improved profile is made possible, due to the fact that the web is formed from a pond, with the formation being controllable by the drainage rate on the wire rather than by a control of the fiber concentration in the slurry.

Difficulties in web-forming techniques have been aggravated by increases in machine widths and speeds as the machinery of the art has developed. As machine speeds have increased, higher flow velocities have been necessitated and the headbox component has been a limiting factor. To obtain a gravity head of stock capable of producing a continuous pulp supply at a proper pressure and delivery velocity, headbox constructions of objectionably excessive dimensions in order to maintain heads of great depths have appeared only to present concomitant problems, particularly in the case of machines operating over wide ranges of speeds.

Herewith, I provide means for supplying stock to each discharge or delivery orifice at desired pressures and velocities.

According to the teaching hereof, adjustable pond regulator is adjustably positionable within the pond of a first stage headbox to provide means by which its lower or bottom wall coacts and defines an adjustable slice or approach passage wherewith it is possible to attain minute changes in the dimensions of the first stage approach passage and hence changes in the velocity of the first stage stock immediately prior to and during formation on the wire. A stage headbox is positionable within the headbox, again to provide means by which defines another adjustable slice or approach passage, again to allow the attainment of minute changes in the dimensions of the second stage approach passage and hence changes in the velocity of the second stage stock immediately prior to and during formation.

The primary stage headbox, inclusive of the pond regulator, and the secondary stage headbox are each adjustable with respect to each other and with respect to the wire which they serve whereby each may be adjustably related to the forming wire in any of a myriad number of positions of angularity, all in manner to give each approach passage a predetermined configuration reflective in the direction and speed of the charge of stock onto the wire in dependence upon the characteristics of the stock employed, the web to be formed therefrom, and the speed of operation.

With the advent of synthetic fibrids adaptable for use in the art of forming sheet-like structures, as distinguished from the common wood pulps, it has been determined that the dispersion problem now dictates techniques different from those normally used in order to insure optimum operating performance at the forming area and to provide for the desired balance of physical properties in the final product, synthetic fibers being normally supplied as short-length papermakers' staple, being readily dispersible in water, and being characterized by cut length and by denier (fiber weight per unit length) with a given denier having a maximum length at which it is possible to obtain a best dispersion.

In conventional processes, the techniques have required the use of an aqueous dispersion of the fibers, wherefor water dispersible fibers of relatively short length, ranging from practically negligible lengths up to lengths of the order of one inch have been used. In most cases, the fibers have been natural fibers which usually are hydrated and have the property of bonding together to form a strong web, the formed paper products being usually relatively dense and stiff and lacking the porosity and textile appearance of non-woven fabrics.

Now with the sheets here envisioned, webs may be made from fibers of textile length or fibers of papermaking length or combinations of the two. Long non-hydrated fibers may be suspended in an extremely large proportion of water, and the resultant dilute suspension may be fed from one of the headboxes onto the wire, the water flowing freely and rapidly through the wire with an avoidance of eddy currents and through the fibrous web deposited on the wire, the fibers being deposited evenly on the wire without any rolling or rippling effects wheretofore a web of uniform and homogeneous texture, free of clots, may be attained.

BRIEF DESCRIPTION OF THE DRAWING

The invention will be better understood from a consideration of the detailed description which follows, when read in conjunction with the accompanying drawings, wherein:

the FIGURE is a view, in side elevation, of an exemplary machine which may be utilized to carry out the invention.

There is shown, fragmentarily and for illustrative purposes only, the wet end of an improved machine on which the step of forming a web may be advantageously carried out. The machine has certain elements and instrumentalities which are of old and well-known constructions and which, are not shown in detail and need not be explicitly described.

It will first be understood that the machine is preferably supported upwardly of a floor or base by means of a base 10 on each of the tending and driving sides of the machine.

A breast roll 12 is extendable across the machine width.

A transversely-extending hinge roll 13 is disposed forwardly of the breast roll and will be movable vertically in an arc from the horizontal plane whereby the inclination of the reach of an endless forming wire 14 between the two rolls may be varied between a lower position of some 8° from the horizontal and an upper position of some 35° from the horizontal.

Forming wire 14 is entrained around the breast and hinge rolls and is further movable forwardly to a couch roll (not shown) at the delivery end of the machine and is further supported by suitable idler and bottom wire rolls (not shown) for the return run of the wire, all as is conventional.

An angle in the order of 15° to 25° is advantageously the optimum operating angle but same can be varied and a somewhat greater or smaller angle can be employed according to the characteristics required in the finished sheet.

Forwardly of the breast roll and rearwardly of the hinge roll and beneath the inclined reach of the forming wire a compartmented suction box 16 is disposed, same constituting the main control unit for drainage and comprising, in essence, a plurality of suction boxes 16*a*, 16*b*, 16*c*, 16*d*, 16*e*, and 16*f* arranged in echelon and maintained each under a variable degree of vacuum by individual suction supply means wherefore the greater part of the water on the wire may be sucked therethrough. Control of drainage therethrough will be accomplished by variations in the amount of vacuum in each as regulated by the conventional valved controls.

These suction boxes may be of any suitable number, and, as they may be of any well known construction, they are not shown in detail.

Supported upwardly of base 10 is a first stage or primary open-topped headbox 20 formed by transversely-spaced vertically-disposed side walls 22 interconnected by a vertically-disposed rearward end wall (not shown) and a generally horizontal bottom wall 24 terminating in an apron 26 at its forwardmost extremity, slightly forwardly of the breast roll and in snug adjacency with the forming wire, all so as to define a pond therewithin cooperantly with the upper surface of the inclined reach of the forming wire.

To prevent the slurry from draining rearwardly beneath the apron and over the breast roll, the usual seal arrangements (not shown) are provided.

The slurry forming the pond is denoted by arrow 28.

Disposed within the first stage headbox is a pond regulator, generally indicated by 40, same being constituted by transversely-spaced vertically-disposed side walls 42, interconnected by a generally vertically-disposed rearward end wall 44 extending therebetween and having unitary therewith and extending generally forwardly therefrom a bottom wall 46.

Said walls cooperantly with the adjacent portion of the uppermost forming surface of the upwardly-inclined section of wire 14 define the bounding walls of a pond.

Side walls 42 of the pond regulator will each be disposed snugly adjacent a respective side wall of the machine, one of which is shown as 50, so as to insure against stock leakage from within the first stage headbox save through a slice 54 defined by the forming wire and the forward terminus or lip of the pond regulator.

The pond regulator functions to control the flow of stock thereunder, its bottom wall converging toward the floor of the pond and the forming wire being adjustable so that the bottom wall may be positioned relative to the wire in obtaining the desired and predetermined convergence as well as the desired dimensioning of the height of the slice.

In piggy-back relation to the first stage headbox, a closed secondary headbox is mounted, same being generally indicated by numeral 60, and comprising the passage 62 having a perforated plate 64 connected therewith and therebelow for the discharge of a secondary slurry into the secondary approach passage 66 defined by the roof 68 of the forward portion of the pond regulator and having its own roof comprised of a rearward portion 70 and a forward portion 72. The perforated plate 64 is arranged above and substantially perpendicular to the secondary approach passage 66, as can be seen in the FIGURE.

Knuckles 74 and 76 at opposite ends of rearward portion 70 facilitate its adjustment in varying the degree of convergence of the rearward portion toward the wire.

Knuckle 76 likewise facilitates the angularization of forward portion 72 as controlled by a jack mechanism 80 symbollically shown by the dot and dash line as connected to the forward terminus of forward portion 72.

Control for the secondary passage is a delicate consideration owing to the fact that headbox feed is from above and at low machine speeds might act as a dropleg and tend to set up objectionable currents. For that condition the control is achieved by the use of a vacuum additionally applied to the top of the header so as, in effect, to offer a control of the flow from such header to the headbox which it supplies and enabling an accurate measurement of the fluent material being fed therewith to the machine.

The vacuum chamber 90 is disposed directly above the secondary chamber. Principally, it serves to control the level of stock in the secondary headbox whereby cascading or entrainment of air is precluded.

For higher machine speeds requiring higher hydrostatic heads, the vacuum chamber 90 will not be required.

Indeed, this secondary nozzletype of headbox may be operated under pressure resulting in higher throughput or higher production capacity of the second ply.

The suction box system previously referred to serves as the main control unit for drainage and is co-extensive with the various openings of the headboxes and the various compartments thereof are connected to suction pumps (not shown) having sufficient capacity to handle the volumes of fluid discharged onto the wire. The result is that the water is sucked through the wire and the newly-formed wet, but porous, highly dispersed and uniform but non-oriented fibers of the web. By providing ample suction at the suction box, substantially all of the water can be drawn downwardly through the web. The regulating of the suction, as well as speed of the machine and position of the pond regulator, can be such as entirely to avoid orientation of the fibers or to create some orientation, if such is desired.

The suction box may be made with a plurality of water extraction compartments which add to the flexibility of drainage control. The compartments, open to the inner face of the wire, may be varied in accordance with various factors, such as variations in the nature of the stock for better control of the thickness and formation of the sheet. Each such compartment preferentially, though not obligatorily, will include air extraction and water extraction conduits for the separate withdrawal of air and water therefrom.

The second stage headbox which fulfills the function of serving the second stage delivery of a slurry from the second pond onto the wire coacts with the pond regulator for the first pond within the first stage compartment by virtue of the fact that its lower or bottom wall coacts with the upper wall of the first stage headbox wherewith it is possible to attain minute changes in the dimensions of the first stage approach passage immediately prior to and during stock formation on the wire.

Such construction permits an improved control of the velocity of the stock at the forming area, it being well known that, for optimum high speed operating stock must be allowed to flow through its discharge orifice and onto the forming area at a requisite velocity. By the pond regulating means hereof, flow velocity is controlled with the primary approach passageway by way of adjusting the positioning of the pond regulator in close proximity to or distantly from the wire, it being appreciated that, the closer the pond regulator to the forming surface, the narrower the discharge, and accordingly, the higher the velocity, the greater the pressure that might be applied in the forming area. Such pressure permits a greater drainage in the available forming area, wherefore more dilute stocks may be used, and further, wherefore heavier webs may be made than would be possible without such pressure. Too, the production of a web having better profile is made possible, due to the fact that the web is formed from a pond, which formation is controllable by the drainage rate on the wire rather than by any control of the fiber concentration in the slurry.

Two systems of control will be observable—first a control by means of widening or restricting the respective slices, and second, a control by means of changing the volume of the respective heads.

In operation, stock is supplied from the pond of the primary headbox to the web-forming region or zone of limited extent defined by that portion of the wire adjacent the discharge orifice of the headbox, as by forcing same through the approach passage and onto the wire forming surface as a layer or ply, the stock so applied containing the required amount of fiber in an amount of water sufficient to produce proper fiber distribution in the layer, with sufficient water drainage being effected during the time period that the formed web remains on the wire to produce a coherent sheet capable of being couched therefrom.

It will be understood that the slurries fed to the respective compartments may vary as to fiber content and the like to meet the requirements of the particular laminated product desired to be formed.

For example, the use of two separate approaches will enable an operator to pass through a first approach passage a slurry of fibers or fibrids for the face of the sheet to impart thereto softness and filmy appearance, to pass through a second approach passage longer and stronger synthetic fibers to give the sheet body.

Because of the myriad combinations of fibers which may be desired, the two compartment arrangement will allow the operator considerable flexibility in achieving same.

Preferentially, each slurry is of the type which will form upon the wire a porous web having a "free" fiber structure characterized by an ability to lose water rapidly, As a result, the water normally filing the interstices of the web as it forms on the wire quickly drains through the wire leaving a web structure which is highly porous to air.

The thickness of the web formed will depend, of course, on the composition or dilution of each slurry and the rate at which the wire is travelling. It is an advantage of the present invention that a very thin initial web will suffice to form the final composite web having good strength characteristics.

The transverse inclined portion or section of the wire forms, in effect, a perforated inclined and movable wall of a box or pond in which, are maintained predetermined levels of the highly-diluted stocks so that, as the wire moves upwardly, the stocks from the boxes flow rapidly onto the wire, the fibers being deposited upon the wire in an even and uniform manner without rolling or rippling and the water passing therethrough. Operationally, the fibers are suspended in extremely large proportions of water, and these dilute suspensions are made to flow freely and rapidly through the inclined section of the wire leaving the fibers deposited on the wire, the water flowing freely and rapidly without eddy currents through the wire and through the web of fibers deposited thereupon, the fibers being deposited evenly on the wire as a web without any rolling or rippling effects, whereby a web of any desired length and of uniform and homogenous texture throughout and free of clots may be achieved.

The advantages of the system here described are several.

The primary headbox design envisions the use of highly-diluted slurries, as for example one made up of synthetic fibers requiring low consistencies, and relatively long forming lengths.

The forming length can be adjusted so as to permit the formation of different fibers and fiber mixes dictating different drainage velocities.

By selectively positioning the pond regulator 40 along the travelling wire, the forming length F1 can be changed to meet the drainage requirements.

Similarly, the forming length F2 can be changed by selectively inserting a longer or a shorter roof 72 of the secondary flow chamber.

The primary lip can be adjustable reference its distance from the forming wire so as to allow total control over the stock flow velocity and accordingly control over the MD:CD ratio.

The piggyback design comprehends the formation of the top sheet or ply immediately following the formation of the base sheet, with a degree of fiber intermingling (base ply or sheet and top ply or sheet), resulting in exceptionally good ply bond.

This degree of fiber intermingling is selective by virtue of the capability of positioning of the primary lip relative to the forming wire.

Further, the secondary headbox is vacuum operated by means of a cooperant air chamber communicating with the secondary header, allowing the control of the speed of application of the top sheet to the base sheet.

The piggyback arrangement offers the further advantage that the secondary headbox will deposit the top sheet irrespective of the location of the pond regulator.

The top sheet normally will be of the lightweight type but it may be formed of slurries of higher consistencies wherewith lower flows may be required.

A further advantage of the extended slice is that pressure formations are developed, all so as to permit higher production rates.

The arrangement offers another distinct advantage in that the secondary headbox can be retrofitted, meaning that the pond regulator is of such configuration that at a subsequent time the secondary headbox can be adapted as an add-on.

I claim:

1. In a delivery system in a machine for forming a continuous multi-ply web upon a moving foraminous-forming wire, the combination of:

an endless forming wire having an upwardly-inclined run defining adjacent primary and secondary areas of a web-forming zone, a primary opened headbox for delivering a primary slurry, a pond regulator having an upper surface and being positionable within the primary headbox, the upward angularization of the run of forming wire and a downward angularization of the pond regulator defining converging bottom and top walls of a primary approach passage with a forward edge of the pond regulator and the forming wire spaced below defining a primary slice, a secondary closed headbox supported by and upwardly of the pond regulator for delivering a secondary slurry and including a secondary roof supported by and forwardly of the secondary headbox for defining a top wall of a secondary approach passage, the upper surface of the pond regulator defining a bottom wall of the secondary approach passage, the upper and bottom walls of the secondary approach passage converging relative to the forming wire in defining a secondary slice, said secondary headbox including a perforated plate arranged above and substantially perpendicular to said secondary approach passage, a two-part dewatering zone beneath the inclined run of the forming wire and divided between a primary forming length and a secondary forming length, each part of the dewatering zone being provided with cooperant suction compartments for assisting in the web formation by the drainage of excess fluent media from the slurries through the forming wire with a resultant deposit of successive webs of fibers on the forming wire.

* * * * *